United States Patent [19]

Kuroyanagi et al.

[11] Patent Number: 4,469,068

[45] Date of Patent: Sep. 4, 1984

[54] FUEL INJECTION APPARATUS

[75] Inventors: Masatoshi Kuroyanagi, Kariya; Masahiko Suzuki; Yasuhiro Horiuchi, both of Aichi, all of Japan

[73] Assignee: Nippondenso Co., Ltd., Kariya, Japan

[21] Appl. No.: 438,724

[22] Filed: Nov. 3, 1982

[30] Foreign Application Priority Data

| | | | |
|---|---|---|---|
| Nov. 10, 1981 | [JP] | Japan | 56-179980 |
| Jul. 9, 1982 | [JP] | Japan | 57-120129 |
| Jul. 9, 1982 | [JP] | Japan | 57-120130 |
| Jul. 16, 1982 | [JP] | Japan | 57-124596 |

[51] Int. Cl.[3] ..... F02M 39/00; F02D 1/06

[52] U.S. Cl. ..... 123/447; 123/506; 417/289

[58] Field of Search ..... 123/506, 496, 447, 446, 123/504; 417/289, 283, 462

[56] References Cited

U.S. PATENT DOCUMENTS

| | | | |
|---|---|---|---|
| 2,810,375 | 10/1957 | Froehlich | 123/447 |
| 3,908,621 | 9/1975 | Hussey | 123/447 |
| 4,029,071 | 6/1977 | Saito | 123/496 |
| 4,164,921 | 8/1979 | Hofer | 123/506 |
| 4,211,203 | 7/1980 | Kobayashi | 123/506 |
| 4,271,805 | 6/1981 | Kobayashi | 123/506 |
| 4,407,253 | 10/1983 | Bauer | 123/506 |

*Primary Examiner*—Charles J. Myhre
*Assistant Examiner*—Carl S. Miller
*Attorney, Agent, or Firm*—Cushman, Darby & Cushman

[57] ABSTRACT

A fuel injection apparatus injects a high-pressure fuel to each combustion chamber of an internal combustion engine. The fuel injection apparatus is provided with an accumulator which controls an amount of injection and an injection period of the high-pressure fuel compressed and supplied from the fuel pressure chamber in accordance with the operation of the internal combustion engine.

37 Claims, 35 Drawing Figures

FUEL INJECTION APPARATUS

BACKGROUND OF THE INVENTION

The present invention relates to a fuel injection apparatus for an internal combustion engine and, more particularly, to a fuel injection apparatus having a means for diverting part of the fuel to an accumulator chamber when the fuel is compressed and supplied.

In conventional fuel injection apparatuses, the fuel is compressed and supplied by a plunger and is then injected from an injection nozzle. In this simple construction, a proper injection rate of a cylinder injection type diesel engine varies in accordance with the engine speed, the engine load, and the engine temperature. Thus, a single fuel injection apparatus can hardly provide an optimum injection rate for the diesel engine of the type described above.

It is therefore desired that a practical apparatus be developed which is capable of controlling the injection rate in accordance with the operating conditions.

A method has been proposed wherein the injection rate is relatively easily changed by constantly accumulating part of the fuel when the fuel is compressed and supplied. However, this conventional method has a disadvantage in that the accumulated amount cannot be arbitrarily controlled due to the high pressure of the fuel. When the accumulated amount of fuel to be injected is optimally set at the time of idling, the accumulated amount of fuel is thus determined at the set level throughout the entire range of the engine speed. For this reason, optimum accumulation characteristics cannot be obtained throughout the above range. As a result, effective combustion cannot be obtained.

SUMMARY OF THE INVENTION

The present invention has been made in consideration of the above mentioned circumstances and has for its object to provide a fuel injection apparatus wherein an accumulated amount of fuel can be freely adjusted to obtain an optimum accumulated amount of fuel throughout the entire range of engine speed.

DETAILED DESCRIPTION OF THE PREFERRED EMBODIMENTS

A fuel injection apparatus of a first embodiment according to the present invention, which is applied to a diesel engine, will be described in detail with reference to FIGS. 1 to 4C.

In the first embodiment, a distributor-type fuel injection apparatus 10 is used.

Figure 1:
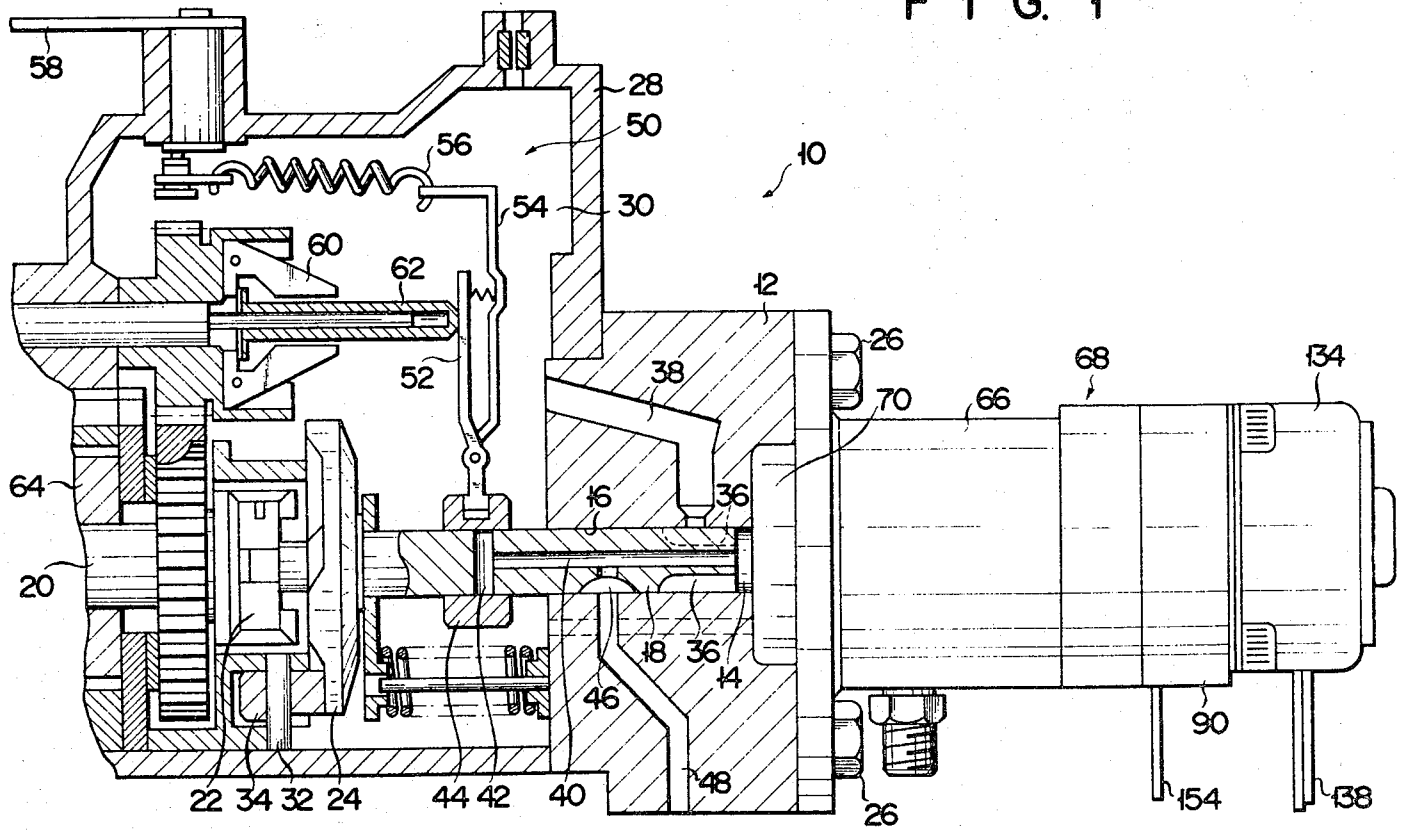
FIG. 1 is a sectional view showing of a fuel injection apparatus, which is applied to a distributor-type, of a first embodiment according to the present invention.

Referring to FIG. 1, the fuel injection apparatus 10 has a housing 12. A through hole 16 which has a circular section is formed in the housing 12 extending along the horizontal direction in the drawing and defines a fuel pressure chamber 14. A columnar plunger 18 is slidably and rotatably inserted in the through hole 16. The plunger 18 is coupled to a drive shaft 20 to be synchronously rotatable with the driving of a diesel engine (not shown) through a coupling 22 and through a face cam 24 secured to one end of the plunger 18. The drive shaft 20, the coupling 22, the face cam 24 and one end of the plunger 18 are housed in a hollow body 28 oiltightly mounted to the housing 12 through bolts 26. The internal space of the body 28 is defined as a fuel supply chamber 30. The coupling 22 continuously transmits the rotational force of the drive shaft 20 to the face cam 24 and allows the face cam 24 to move along the axial direction of the drive shaft 20.

A cam roller 34 is rotatably disposed in the body 28 through a support shaft 32 and opposes a cam surface formed on the peripheral portion of the face cam 24. The face cam 24 reciprocates by abutment the cam surface against the cam roller 34 when the face cam 24 is rotated by the drive shaft 20. Thus, upon rotation of the drive shaft 20, the plunger 18 reciprocates. The number of strokes of the plunger 18 during one rotation thereof corresponds to the number of cylinders of the engine.

On an intake stroke, that is, a movement of the plunger 18 toward the left in FIG. 1, fuel is taken into the fuel pressure chamber 14 which is defined by the other end of the plunger 18 and the inner face of the through hole 16. A plurality of intake grooves 36 are axially formed on the outer peripheral surface at the other end of the plunger 18, and each of the intake grooves 36 is open to the fuel pressure chamber 14 at its one end. An intake bore 38 having one end open to the fuel supply chamber 30 is formed in the housing 12. On the intake stroke, upon rotation of the plunger 18, one of the intake grooves 36 opposes the intake bore 38 and communicates therewith. Thus, fuel is supplied from the fuel supply chamber 30 to the fuel pressure chamber 14.

A bore 40 is axially formed in the plunger 18 and has one end open to the other end face of the plunger 18 that is, open to the fuel pressure chamber 14. The other end of the bore 40 opens to the outer face of the plunger 18 through a bore 42 which radially extends within the plunger 18. The fuel pressure chamber 14 can communicate with the fuel supply chamber 30 through the bores 40 and 42. The openings of the bore 42 are closed/opened by a spill ring 44 to be described later in order to selectively communicate the fuel pressure chamber 14 with the fuel supply chamber 30. A distribution groove 46 is formed at an intermediate portion on the outer circumferential surface of the plunger 18, one end of the distribution bore 46 communicates with the bore 40 and the other end thereof opens to the outer periperal surface of the plunger 18. In the housing are formed exhaust bores 48 with which the bore 40 can communicate, the number of which corresponds to the number of cylinders of the engine. One end of each exhaust bore 48 is open to the inner face of the through hole 16 and can oppose the distribution groove 46. The other end of each exhaust bore 48 is connected to an injection nozzle (not shown).

In the fuel injection apparatus having the above construction, when the communication with the intake groove 36 and the intake bore 38 upon rotation of the plunger 18, and when the plunger 18 is moved to the right in FIG. 1, the compression stroke takes place. At the beginning of the compression stroke, the distribution groove 46 does not communicate with any exhaust bore 48. When the plunger 18 is further moved to the right in FIG. 1, the fuel is compressed in the fuel pressure chamber 14. When the pressure of the fuel reaches a predetermined value, the distribution groove 46 communicates with one of the exhaust bores 48. As a result, the compressed fuel is supplied to a predetermined injection nozzle through this exhaust bore 48.

The spill ring 44 serves as a member for adjusting the amount of fuel injection and is so disposed as to determine the termination of fuel injection. The spill ring 44 is oiltightly fitted around the outer circumferential surface of the plunger 18 and is axially movable therealong. In the normal position, the spill ring 44 is held at a position to close the bore 42 and is moved to open the bore 42 at a predetermined timing controlled by a timing control mechanism 50 to be described in detail later. When the bore 42 is opened, the fuel pressure chamber 14 communicates during the compression stroke with the fuel supply chamber 30, so that the fuel in the fuel pressure chamber 14 is not compressed any longer and returns to the fuel supply chamber 30 upon movement of the plunger 18 to the right. In other words, at the time where the bore 42 is opened, fuel injection is stopped, and the amount of fuel injected into the cylinders of the engine is determined.

The timing control mechanism 50 has a supporting lever 52 for supporting at one end thereof the spill ring 44. The supporting lever 52 is elastically coupled to an adjusting lever 58 through a tension lever 54 and a spring 56. A governor sleeve 62 which is ganged with movement of a flyweight 60 abuts against the other end of the supporting lever 52 so as to define movement of the supporting lever 52 urged by the spring 56. The flyweight 60 is rotated in accordance with the engine speed and is moved by its centrifugal force to control the position of the spill ring 44 through the supporting lever 52. The adjusting lever 58 is connected to an accelerator pedal (not shown). The degree of a force applied to the accelerator pedal controls the position of the spill ring 44. The timing control mechanism 50 of the type described above is known to those who are skilled in the art, and a detailed description thereof will be omitted.

A feed pump 64 is mounted on the drive shaft 20 in the fuel supply chamber 30. The fuel compressed by the feed pump 64 is filled into the fuel supply chamber 30. The fuel pressure is controlled in association with the engine speed by a pressure control valve in a known manner. The pressure of the fuel is increased with an increase in the engine speed.

A cap 66 is secured through the bolts 26 to that portion of the housing 12 which is located at the right-hand side of the fuel pressure chamber 14 in FIG. 1. An accumulator 68 is mounted on the cap 66.

Figure 2:
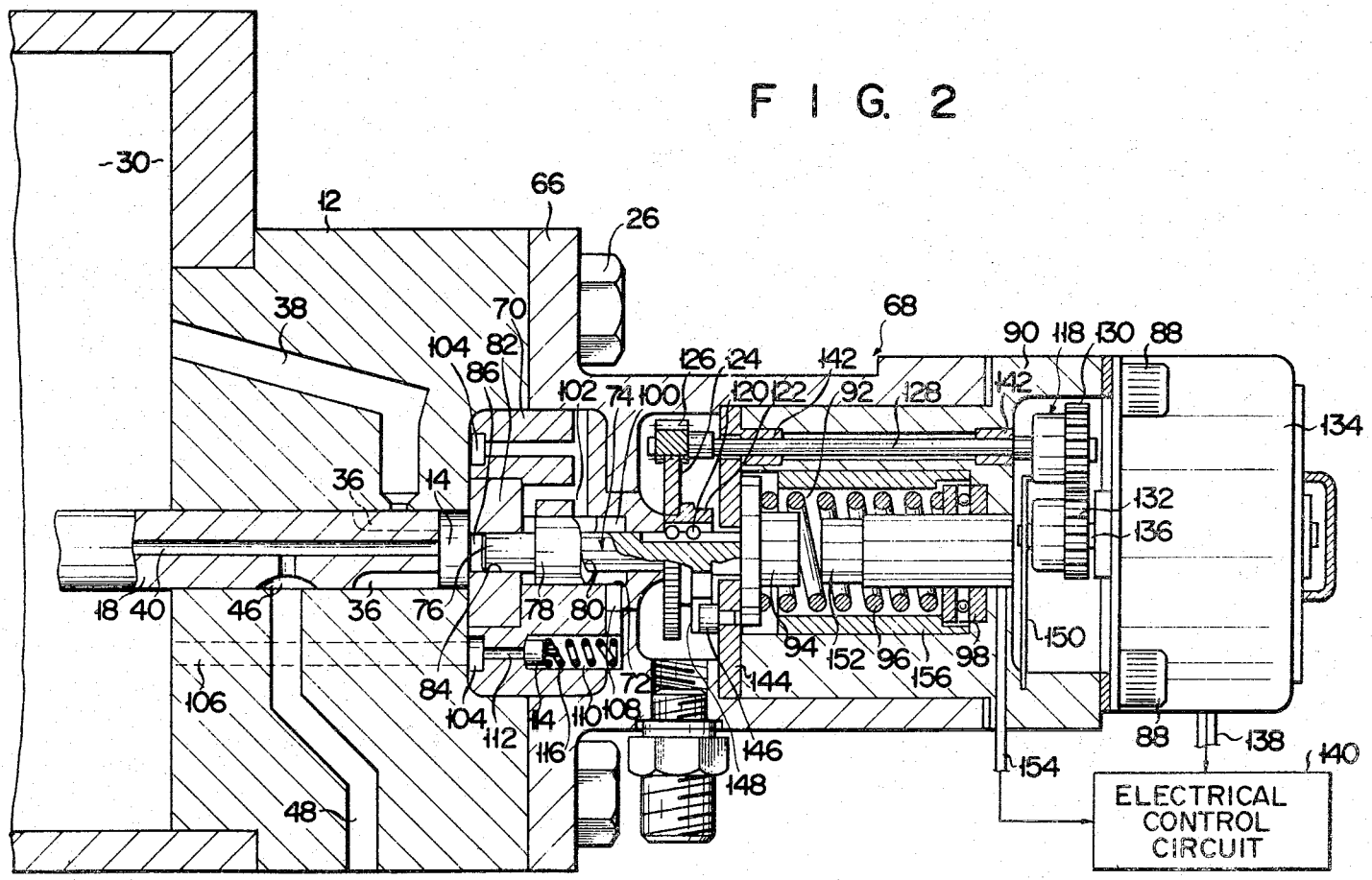
FIG. 2 is a sectional view of an accumulator used for the fuel injection apparatus shown in FIG. 1.

The detailed configuration of the accumulator 68 is shown in detail in FIG. 2. A cylinder 70 is fitted in a contact portion between the housing 12 and the cap 66. A piston 74 is inserted in a through hole 72 of the cylinder 70. The piston 70 has a cylindrical body 76 and a large-diameter portion 78 which is formed at the intermediate portion of the cylindrical body 76 and defines a spill lead. The through hole 72 is of sufficient size to oiltightly and slidably accommodate the large-diameter portion 78 therein. The right end face (in FIG. 2) of the large-diameter portion 78 is defined as a helical control surface 80. A seat 82 is secured to that portion of the cylinder 70 which opposes the fuel pressure chamber 14. A through hole 84 is formed in the seat 82 to communicate the through hole 72 of the cylinder 70 with the fuel pressure chamber 14, and the left end portion (in FIG. 2) of the cylindrical body 76 of the piston 74 is inserted in the through hole 84. The through hole 84 is of sufficient size to oiltightly and slidably accommodate the cylindrical body 76 of the piston 74 therein. A space formed by the inner circumferential surface of the through hole 84 and the left end face of the piston 74 is defined as an accumulation chamber 86.

The accumulator 68 has a cylindrical body 90 mounted in the inner face of the cap 66 through bolts 88. The left end portion of the cylindrical body 90 is located substantially at the middle portion of the inner circumferential surface of the cap 66. The inner space of the cylindrical body 90 is defined as a spring housing 92. The right end portion of the piston 74 extends in the spring housing 92. A pressure plate 94 is secured to the right end portion of the piston 74. A coil spring 96 is housed in the spring housing 92. The left end of the coil spring 96 abuts against the pressure plate 94, and the right end thereof abuts against the right wall of the cylindrical body 90 through a thrust bearing 98. The piston 74 is constantly urged toward the left in FIG. 2 by the urging force of the coil spring 96. Therefore, if no pressure of the compressed fuel from the fuel pressure chamber 14 is applied to the piston 74 through the accumulation chamber 86, the left wall of the large-diameter portion 78 of the piston 74 abuts against the right wall of the seat 82 by the urging force of the coil spring 96.

Upon movement of the plunger 18 to the right in the compression stroke, the left end face of the piston 74 receives the pressure of the compressed fuel, so that the piston 74 is moved to the right in FIG. 2 against the urging force of the coil spring 96. Upon movement of the piston 74, the size of the accumulator chamber 86 is increased.

A space formed by the inner circumferential and right end surfaces of the through hole 72 of the cylinder 70, the control surface 80 and the outer circumferential surface of the cylindrical body 76 is defined as an oiltight chamber 100. A control bore 102 is formed in the cylinder 70. One end of the control bore 102 is open at a predetermined position of the through hole 72. The other end of the control bore 102 is open at the left end face of the cylinder 70. An annular groove 104 is formed at the left end face of the cylinder 70. The control bore 102 communicates with the annular groove 104. The annular groove 104 communicates with the fuel supply chamber 30 through a communicating bore 106 formed in the housing 102. In other words, the oiltight chamber 100 communicates with the fuel supply chamber 30 through the control bore 102, the annular groove 104 and the communicating bore 106.

Figure 3:
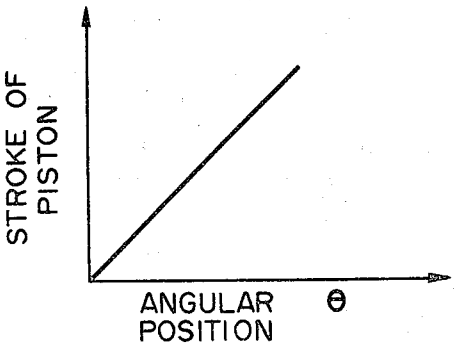
FIG. 3 is a graph showing the stroke of a piston as a function of the angular position of the piston.
Figure 4B:
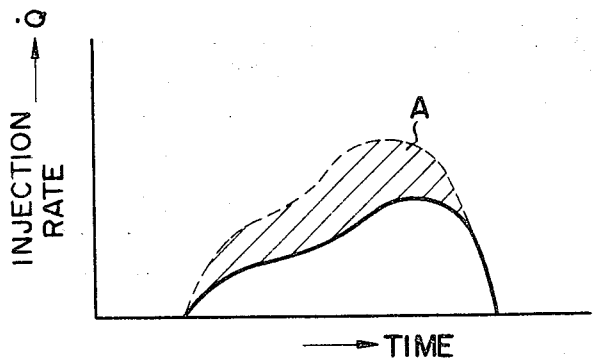

Upon axial movement of the piston 74, the opening of the control bore 102 is closed by the outer circumferential surface of the large-diameter portion 78. The timing at which the control bore 102 is closed depends on the rotating position of the piston 74. The right end face of the large-diameter portion 78 the piston 74 comprises the helical control surface 80 and constitutes the spill lead, so that the stroke between the control bore 102 and the control surface 80 of the large-diameter portion 78 changes linearly as a function of the angular position of the piston 74, as shown in FIG. 3. The piston 74 is moved to the right by a predetermined stroke determined by a given angular postion, thus, the control bore 102 is closed by the piston 74. In accordance with the above predetermined stroke, the volume of the accumulation chamber 86, that is, the accumulation amount, is determined. Before the control bore 102 is closed by the piston 74, the oiltight chamber 100 communicates with the fuel supply chamber 30. The fuel in the oiltight chamber 100 returns to the fuel supply chamber 30 upon movement of the piston 74 to the right. When the control bore 102 is closed, the oiltight chamber 100 does not communicate with the fuel supply chamber 30. The fuel remains in the oiltight chamber 100, so that the right-hand movement of the piston 74 is stopped.

An intake bore 108 is formed in the cylinder 70. One end of the intake bore 108 is open to the oiltight chamber 100 in the same manner as the control bore 102. An intake valve chamber 110 is formed in the cylinder 70. The right end of the intake valve chamber 110 communicates with the other end of the intake bore 108, and the left end thereof communicates with the annular groove 104 through a channel 112. A valve plug 114 is housed in the intake valve chamber 110 and allows the opening of the channel 112 to open. The valve plug 114 is urged by a spring 116 which is disposed in the intake valve chamber 110 to close the opening of the channel 112. By this mechanism, the fuel may not return from the oiltight chamber 100 to the fuel supply chamber 30 through the intake valve chamber 110. When the pressure of the fuel in the fuel supply chamber 30 reaches a predetermined pressure, the valve plug 114 opens the channel 112 against the urging force of the spring 116, so that fuel is supplied from the fuel supply chamber 30 to the oiltight chamber 100 through the intake valve chamber 110.

A piston rotating mechanism 118 will now be described in detail, which defines the angular position of the piston 74.

A gear holder 122 is secured to the right end portion of the cylindrical body 76 of the piston 74 through steel balls 120. The gear holder 122 rotates integrally with the piston 74 by means of the steel balls 120 and is axially movable. A driven spur gear 124 is secured to the gear holder 122 to be coaxial therewith. A driving spur gear 126 constantly meshes with the driven spur gear 124. The driving spur gear 126 is mounted at one end of a transmission shaft 128. A transmission gear 130 is mounted at the other end of the transmission shaft 128. The transmission gear 130 meshes with a transmission gear 132. The transmission gear 132 is mounted on a drive shaft 136 of a stepping motor 134.

The piston 74 is arbitrarily held at an angular position by the piston rotating mechanism 118 having the above construction. In other words, a stroke during which the control bore 102 of the piston 74 is closed, and therefore the accumulation amount, is arbitrarily determined by the piston rotating mechanism 118. The stepping motor 134 is connected to an electrical control circuit 140 through a cord 138. The electrical control circuit 140 controls the degree of rotation of the drive shaft 136. The electrical control circuit 140 detects the engine speed, the engine lead and the engine temperature and generates a control signal to the stepping motor 134 to provide the optimum accumulation amount.

The transmission shaft 128 is supported on the cylindrical body 90 by means of a pair of sliding bearings 142 so as to decrease the friction resistance, and hence to decrease the starting torque of the stepping motor 134. A stopper plate 144 is sandwiched between adjoining portions of the cylindrical body 90 and the cap 66. The pressure plate 94 urged by the coil spring 96 is supported by the stopper plate 144. In this manner, the stopper plate 144 prevents an excessive load from being applied to the piston 74.

A pin 146 is mounted on the left-hand side (in FIG. 2) of the stopper plate 144. A stopper 148 is disposed at the gear holder 122. When the stopper 148 abuts against the pin 146, the initial position in the rotational movement of the piston 74 is determined. When the stepping motor 134 is deenergized, the gear holder 122 restores the initial position by the force of a spiral spring 150 mounted on the drive shaft 136. The initial position of the gear holder 122 is defined by the pin 146. Thus, the initial position of rotation of the piston 74 is determined.

A gap sensor 152 is disposed in the cylindrical body 90. The gap sensor 152 measures a distance between itself and the pressure plate 94. A detection signal from the gap sensor 152 is supplied to the electrical control circuit 140 through an amplifier (not shown) via a cord 154. The detection signal is fed back to the stepping motor 134 which is then controlled. A stopper 156 is disposed to surround the coil spring 96 so as to prevent the pressure plate 94 from colliding with the gap sensor 152.

The operation of the fuel injection apparatus having the above construction will be described hereinafter.

The plunger 18 is rotated in synchronism with a diesel engine (not shown) and is simultaneously reciprocated by the face cam 24. During the reciprocal movement of the plunger 18, when it is moved to the left, that is, when the intake stroke is performed, one of the intake grooves 36 formed in the plunger 18 communicates with the intake bore 38 extending in the housing 12. Fuel in the fuel supply chamber 30 is supplied to the fuel pressure chamber 14. Alternately, as the plunger 18 is moved to the right, and, when the exhaust stroke is performed, the distribution groove 46 which communicates with the fuel pressure chamber 14 through the bore 40 axially extending in the plunger 18 communicates with the exhaust bore 48 extending in the housing 12. As a result, fuel in the fuel pressure chamber 14 is supplied from the exhaust bore 48 to an injection nozzle (not shown).

When the plunger 18 is moved to the right and the fuel in the fuel pressure chamber 14 is compressed, the piston 74 receives the pressure of the compressed fuel at its left end face. Therefore, the piston 74 is moved to the right against the urging force of the coil spring 96. The fuel in the oiltight chamber 100 is compressed by the piston 74, so that part of the fuel which corresponds to the displacement of the piston 74 in amount returns to the fuel supply chamber 30 through the control bore 102. When the control surface 80 as the spill lead of the large-diameter portion 78 of the piston 74 reaches a position to close the control bore 102, the fuel in the oiltight chamber 100 remains therein, and hence the piston 74 is stopped. Therefore, since the fuel corresponding to the displacement of the piston 74 in its amount is supplied to the accumulation chamber 86, the amount of fuel injected from the exhaust bore 48 is decreased by the fuel corresponding to the displacement of the piston 74, that is, by the accumulation amount.

In the intake stroke of the plunger after the fuel is compressed and fed, the pressure of the fuel in the fuel pressure chamber 14 is decreased, so that the piston 74 is moved to the left until it abuts against the seat 82 by the urging force of the coil spring 96. In this stroke, since the pressure of the fuel in the oiltight chamber 100 is decreased, the valve plug 114 of the intake valve chamber 110 is opened by the pressure of the fuel in the fuel supply chamber 30. The fuel in the fuel supply chamber 30 is supplied to the oiltight chamber 100 through the intake bore 108. When the piston 74 is further moved to the left to cause the large-diameter portion 78 of the piston 74 to open the control bore 102, the fuel in the fuel supply chamber 30 also flows into the oiltight chamber 100 through the control bore 102. When the pressure of the fuel in the oiltight chamber 100 becomes equal to that of the fuel in the fuel supply chamber 30, the valve plug 114 is moved by the urging force of the spring 116 to close the channel 112, thereby completing preparation for the next fuel injection process.

As may be apparent from the above description, the displacement of the piston 74 determines the amount Q of fuel injected. The displacement of the piston 74 is determined by the relative distance between the control bore 102 and the control surface 80 along the axial direction of the fuel injection apparatus. When the stepping motor 134 is started to rotate the piston 74 with the starting torque by a predetermined angle $\theta$ through the driven spur gear 124, the spill lead constituted by the control surface 80 has a helical shape. The axial distance of the spill lead with respect to the control bore 102, that is, the stroke, is changed, as shown in FIG. 3. The displacement of the piston 74 is thus adjusted by the above distance, and hence the amount Q of fuel injected is controlled.

Figure 4A:
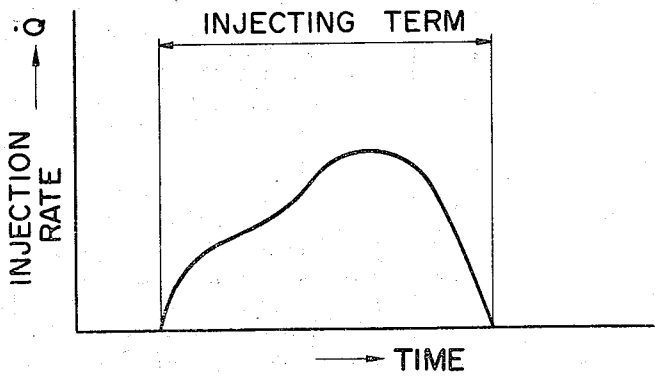
FIGS. 4A to 4C are graphs showing the injection rate as a function of time.
Figure 4C:
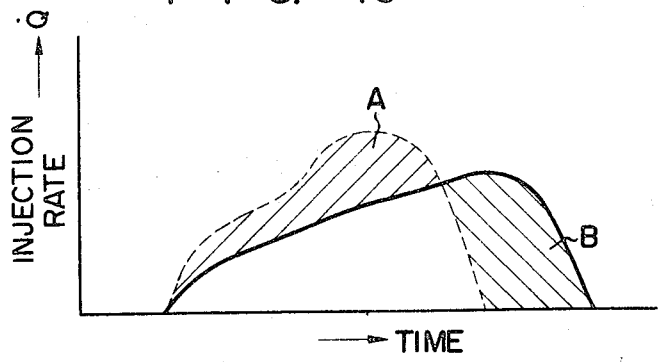

In a low-speed operation such as idling, the piston 74 is rotated by the stepping motor 134 to increase a stroke between the control bore 102 and the spill lead of the control surface 80. This allows a great decrease in the amount Q of fuel injected since a curve in FIG. 4A (where the accumulation amount is zero) is greatly changed to a curve indicated by the solid line in FIG. 4B. The amount of the decrease is indicated by a hatched area A in FIG. 4B. In this case, in order to compensate for a decreased amount of injected fuel, the position of the adjusting lever 58 at idling is adjusted to increase an injection period as compared with injection periods at medium- and high-speed operations. The area A is replaced by a hatched area B in FIG. 4C. In this manner, without changing the amount Q of fuel injected during idling, the injection period can be changed as shown in FIG. 4C. As a result, noise during idling is decreased.

It is noted that $\dot{Q}$ indicates the injection rate of the fuel, and that the integrated value of the curve over time indicates the amount Q of fuel injected.

At medium- and high-speed operations where engine speeds are increased, the piston 74 is rotated by the stepping motor 134 to cause the control surface 80 to move axially, thus shortening the stroke. As a result, displacement of the piston 74 is decreased. At the beginning of the intake stroke of the plunger 18, the large-diameter portion 78 closes the control bore 102. The displacement of the piston 74 is thus decreased. As shown in FIG. 4A, the amount Q of injected fuel is not decreased, but the injection rate $\dot{Q}$ is abruptly increased. In this manner, by controlling power to the stepping motor 134 in accordance with the rotational frequency of the fuel injection apparatus, the angular displacement of the piston 74 is changed to adjust the stroke between the control bore 102 and the control surface 80. As a result, the injection rate $\dot{Q}$ until ignition can be decreased, and effective combustion can be performed.

At the time of starting the engine, the stroke between the control bore 102 and the control surface 80 is further decreased so as to close the control bore 102 by the large-diameter portion 78 from the very beginning of the intake stroke of the plunger 18. The displacement of the piston 74, and therefore the accumulation amount, becomes substantially zero, and the amount Q of injected fuel may not be decreased. Therefore, when the injection period is set in the same manner as in idling, an increase in the amount Q of injected fuel at the engine start can be performed, thus providing a smooth engine start.

As described above, according to the fuel injection apparatus 10 of the first embodiment of the present invention, the accumulation amount can be adjusted in accordance with the engine speed. Any amount of injected fuel can be properly determined corresponding to any engine speed, thus providing smooth engine operation.

In order to determine the reference position of the stepping motor 134, the piston 74 is automatically restored to a predetermined position by the spiral spring 150 and the pin 146. Therefore, when this predetermined position corresponds to the position at idling, excessive rotation of the stepping motor 134 due to vibration can be reset each time idling is performed. Further, since the axial position of the piston 74 is measured by the gap sensor 152, the detection signal can be fed back to the stepping motor 134 which can then be highly precisely controlled.

The present invention is not limited to the first embodiment described above. Various changes and modifications may be made within the spirit and scope of the present invention. For example, when the gap sensor 152 is used, the spiral spring 150 and the pin 146 need not be used. In some cases, the spiral spring 150 and the pin 146 may be omitted to provide a simple construction. Furthermore, the rotational angle and displacement of the piston 74 may be controlled by measuring the number of steps of the stepping motor 134. In such cases, the gap sensor 152 may be omitted.

Various embodiments of the present invention will be described hereinafter. The same reference numerals as used in the first embodiment denote the same parts throughout the following embodiments, and a detailed description thereof will be omitted.

Figure 5:
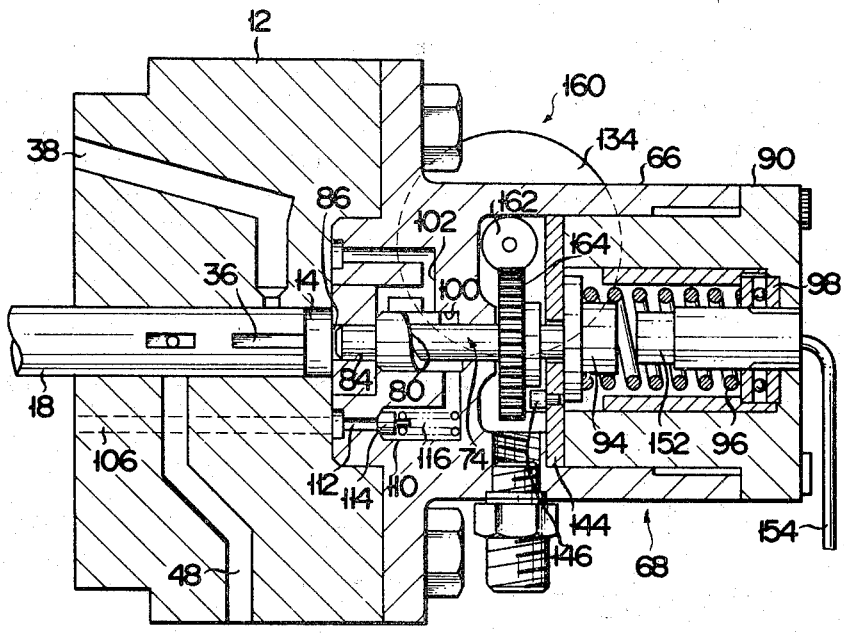
FIG. 5 is a sectional view showing of a fuel injection apparatus of a second embodiment according to the present invention.
Figure 6:
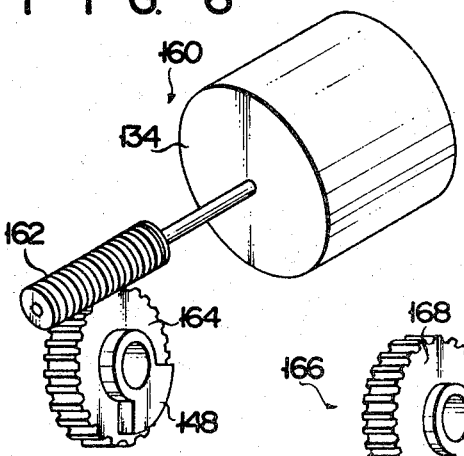
FIG. 6 is a perspective view of a piston rotating mechanism used in the fuel injection apparatus shown in FIG. 5.

A fuel injection apparatus according to a second embodiment will be described with reference to FIGS. 5 and 6.

In the first embodiment, the piston rotating mechanism 118 is arranged to transmit the rotational force of the stepping motor 134 to the piston 74 through the first and second transmission gears 130 and 132, the transmission shaft 128, and the driven and driving spur gears 124 and 126. However, in the second embodiment, a piston rotating mechanism 160 comprises a worm gear 162 and a worm wheel 164, as shown in FIG. 6. The worm gear 162 is mounted on the rotating shaft of a stepping motor 134, while the worm wheel 164 is coupled to the piston 74.

The torque of the worm gear 162 is increased by the worm wheel 164, so that the starting torque of the stepping motor 134 can be small. Thus, the stepping motor 134 may comprise a compact motor. Furthermore, the precision of each step of the stepping motor 134 in controlling the rotational movement of the piston 74 is improved. In other words, the rotational frequency of the stepping motor 134 is decreased and transmitted to the piston 74. In this manner, the angular position of the piston 74 can be very precisely controlled.

Figure 7:
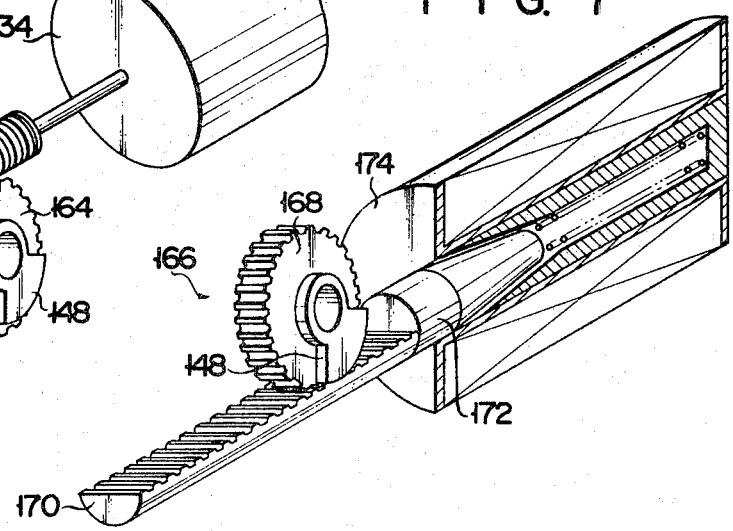
FIG. 7 is a perspective view of a piston rotating mechanism used in a fuel injection apparatus of a third embodiment according to the present invention.

FIG. 7 shows a fuel injection apparatus of a third embodiment according to the present invention. In this embodiment, a piston rotating mechanism 166 comprises a pinion gear 168 coupled to the piston 74, a rack 170 which meshes with the pinion gear 168, and a linear solenoid 174 which connects the rack 170 to a plunger 172.

Figure 8A:
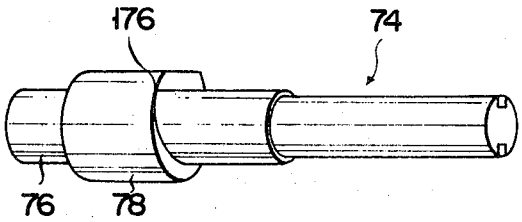
FIGS. 8A and 8B are a perspective view and a side view respectively which show the shape of a control surface incorporated in a fuel injection apparatus of a fourth embodiment according to the present invention.
Figure 8B:
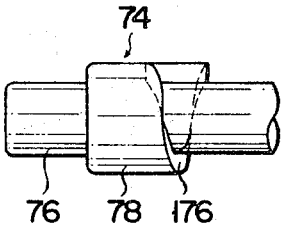
Figure 9A:
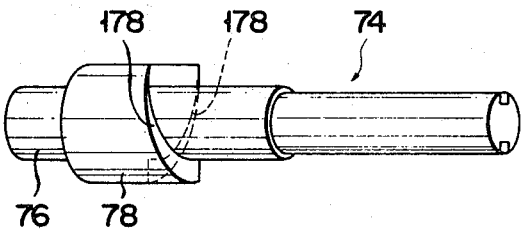
FIGS. 9A and 9B are a perspective view and a side view respectively which show the shape of a control surface incorporated in a fuel injection apparatus of a fifth embodiment according to the present invention.
Figure 9B:
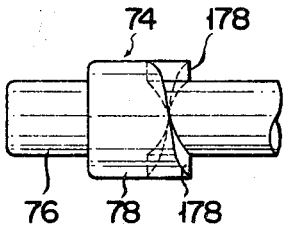
Figure 10A:
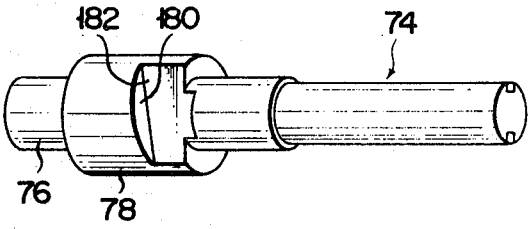
FIGS. 10A and 10B are a perspective view and a side view respectively which show the shape of a control surface incorporated in a fuel injection apparatus of a sixth embodiment according to the present invention.
Figure 10B:
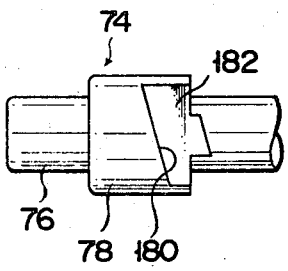

FIGS. 8A and 8B to FIGS. 10A and 10B show shapes of control surfaces 176, 178 and 180 of large-diameter portions 78 of pistons 74 of fourth to sixth embodiments, respectively, according to the present invention. The control surface 176 of the piston 74 of the fourth embodiment as shown in FIGS. 8A and 8B comprises a helical surface whose spiral corresponds to one pitch. Two spiral control surfaces 178 are provided in the fifth embodiment shown in FIGS. 9A and 9B. Each surface 178 corresponds to a half pitch. The control surface 180 of the sixth embodiment shown in FIGS. 10A and 10B has a notch 182, which can be easily formed.

As may be apparent from the control surfaces of the fourth to sixth embodiments shown in FIGS. 8A and 8B to FIGS. 10A and 10B, respectively, the control surface may have any shape such that the piston 74 may be rotated and simultaneously moved in the axial direction so as to change the stroke to the control bore 102.

A fuel injection apparatus of a seventh embodiment according to the present invention will be described with reference to FIGS. 11 to 13B. In the first embodiment, the piston 74 is integrally constructed. However, the present invention is not limited to such a construction.

Figure 11:
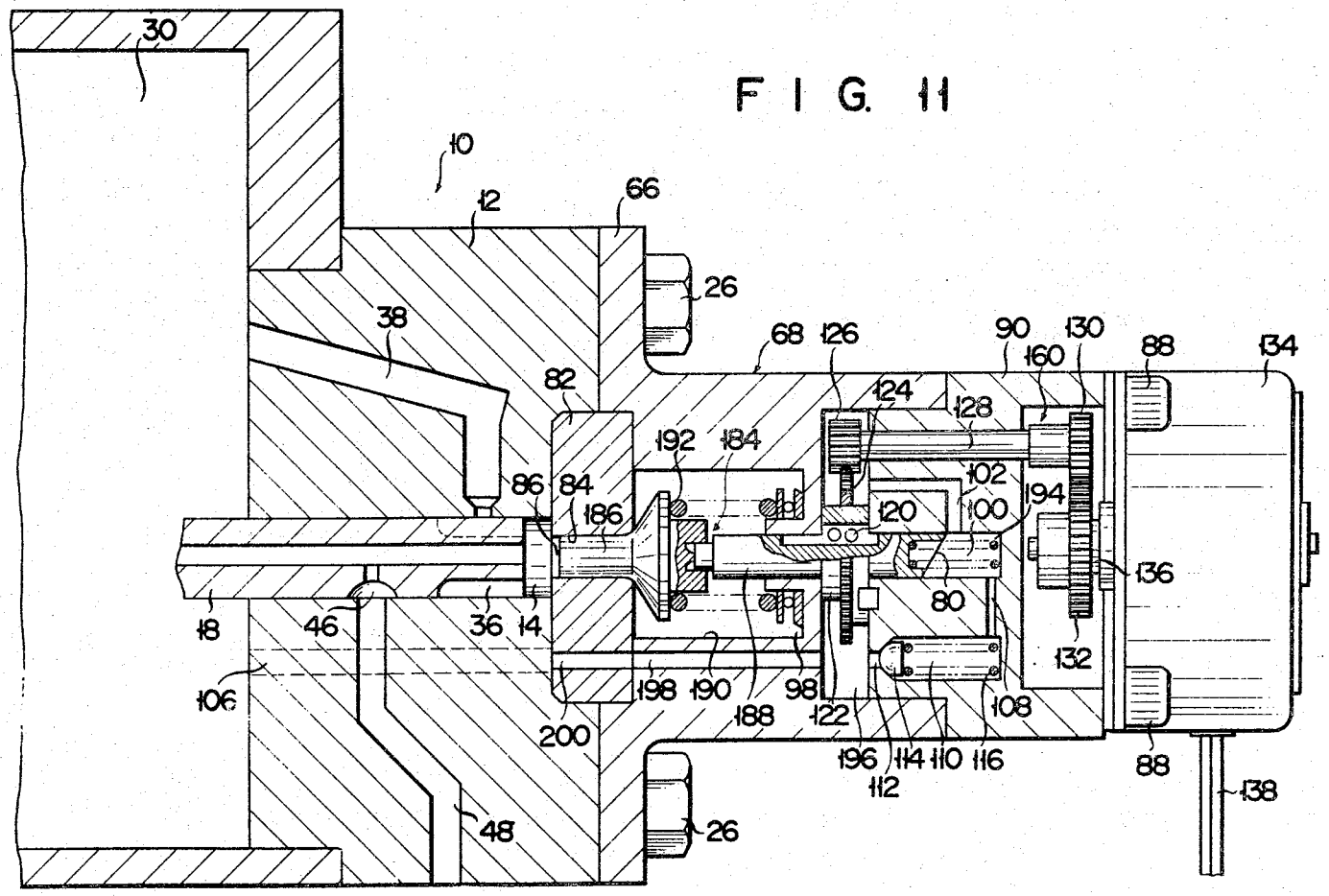
FIG. 11 is a sectional view of a fuel injection apparatus of a seventh embodiment according to the present invention.

As shown in FIG. 11, a piston assembly 184 comprises an accumulation piston 186 and a pressure pin 188 which is coaxial with the accumulation piston 186 and is disposed to be detachable therefrom. The pressure pin 188 is rotatable with respect to the accumulation piston 186. The right end portion of the accumulation piston 186 is located in a spring chamber 190 formed in the cap 66. A first spring 192 is disposed in the spring chamber 190 to urge the accumulation piston 186 to the left in FIG. 11.

Figure 12:
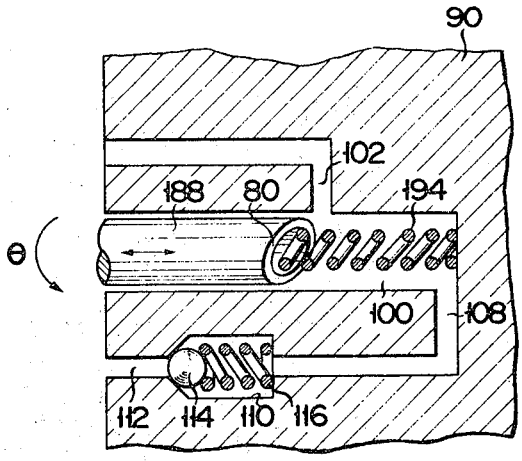
FIG. 12 is a perspective view showing the inside of an oiltight chamber.
Figure 13B:
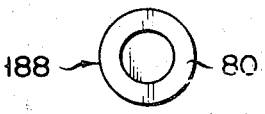
FIGS. 13A and 13B are a front view and a side view respectively which show the control surface of the fuel injection apparatus shown in FIG. 11.
Figure 13A:
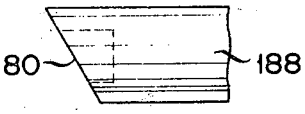

The left end portion of the pressure pin 188 is located in the spring chamber 190 and pivotally engages the right end portion of the accumulation piston 186. The right end portion of the pressure pin 188 is located in an oiltight chamber 100 formed in the body 90. A second spring 194 is disposed in the oiltight chamber 100 to urge the pressure pin 188, and hence the accumulation piston 186, to the left in FIG. 11. The urging force of the second spring 194 is weaker than that of the first spring 192. The right end of the first spring 192 engages with the thrust bearing 98. The right end face of the pressure pin 188 is obliquely chamfered to form the control surface 80, as shown in FIGS. 12, 13A and 13B.

A space between the cap 66 and the body 90 defines a gear chamber 196. A gear holder 122 is mounted on the outer face of the pressure pin 188 which is located in the gear chamber 196 through steel balls 120. The control bore 102, the intake bore 108, the intake valve chamber 110 and the channel 112 are disposed in the body 90. The control bore 102 and the channel 112 are open to the gear chamber 196. The gear chamber 196 constantly communicates with the fuel supply chamber 30 through a channel 198, a channel 200 formed in the seat 82, and the communicating bore 106.

The fuel injection apparatus 10 of the seventh embodiment according to the present invention has the following advantages.

Most of the urging force due to the pressure from the fuel pressure chamber 14 is received by the first spring 192. For this reason, the load applied to the pressure pin 188 is smaller than that applied to the accumulation piston 186. Unlike the structure where an accumulation piston is directly pivoted, the load to rotate the pressure pin 186 is decreased. If the contact portion between the accumulation piston 186 and the pressure pin 188 comprises arcuated contact portion, the resistance to rotational movement can be decreased. As a result, the angular position of the pressure pin 188 can be very precisely controlled.

Figure 15B:
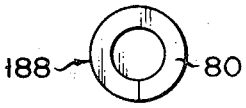
FIGS. 15A and 15B are a front view and a side view respectively which show the control surface of the fuel injection apparatus shown in FIG. 14.
Figure 14:
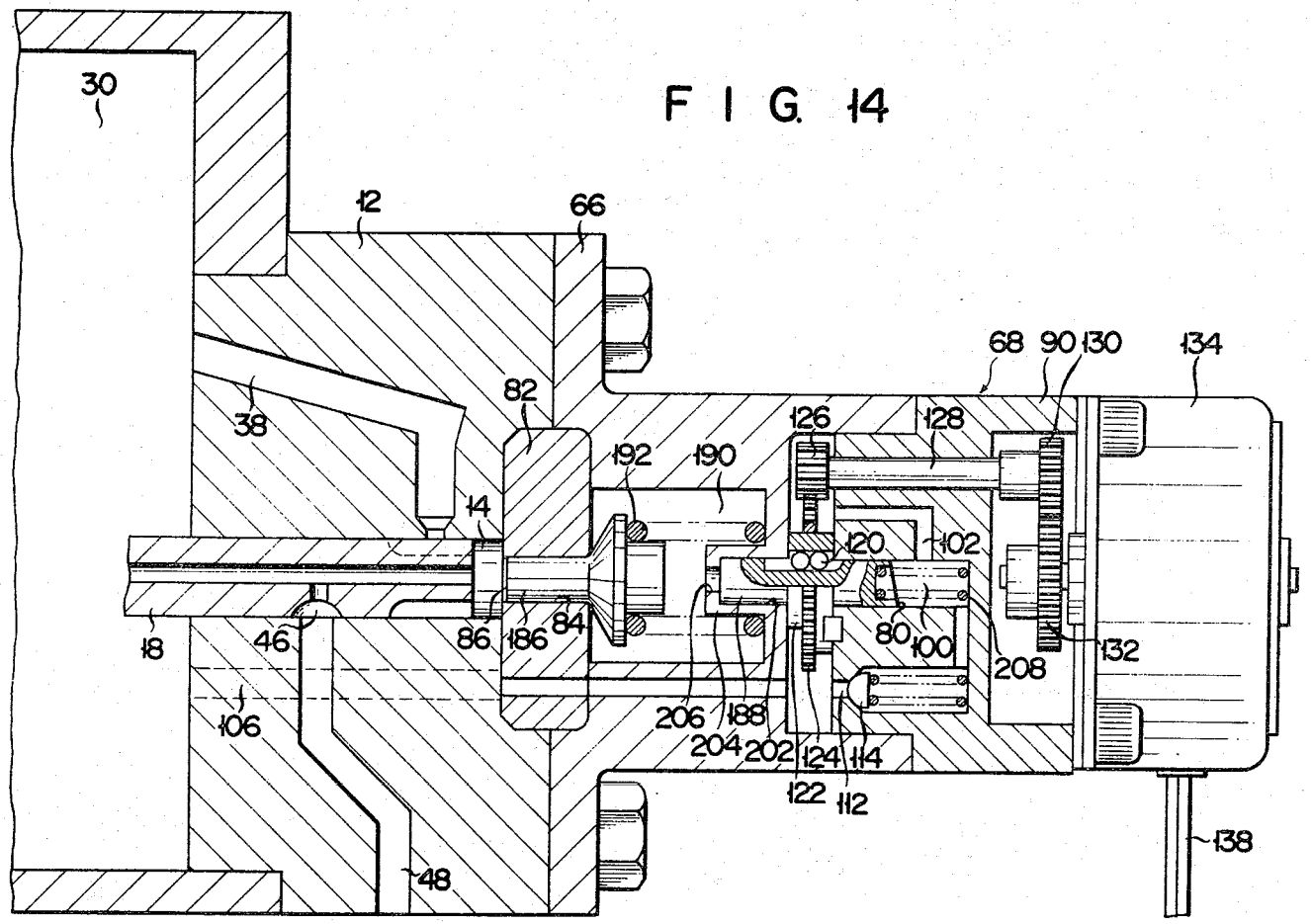
FIG. 14 is a sectional view of a fuel injection apparatus of an eighth embodiment according to the present invention.

A fuel injection apparatus of an eighth embodiment according to the present invention will be described with reference to FIGS. 14 to 15B. In the seventh embodiment, the accumulation piston 186 and the pressure pin 188 which constitute the piston assembly 184 are brought into contact with each other and are coupled to each other. However, in the eighth embodiment, they are spaced apart from each other and are hydraulically coupled to each other. A recess 202 is formed in the right end face of the cap 66 which opposes the oiltight chamber 100. The left end portion of the pressure pin 188 is oiltightly inserted in the recess 202. A through hole 206 which allows the spring chamber 190 to communicate with the recess 202 is formed in a left wall 204 which defines the left end of the recess 202. A working fluid is filled in the spring chamber 190.

Figure 15A:
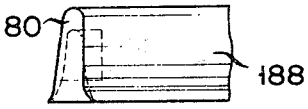
Figure 16B:
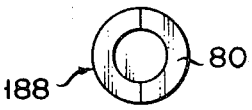
FIGS. 16A and 16B are a front view and a side view respectively which show a control surface of a fuel injection apparatus of a ninth embodiment according to the present invention.
Figure 16A:
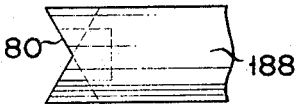
Figure 17B:
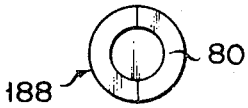
FIGS. 17A and 17B are a front view and a side view respectively which show a pressure pin (control surface) of a fuel injection apparatus of a tenth embodiment according to the present invention.
Figure 17A:
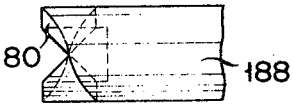

In the fuel injection apparatus of the eighth embodiment according to the present invention, the accumulation piston 186 and the pressure pin 188 are hydraulically coupled to each other. When the accumulation piston 186 is moved to the right, the pressure pin 188 is moved to the right through the working fluid. The pressure pin 188 can be restored to its initial position by means of a spring 208 disposed in the oiltight chamber 100. The control surface 80 of this apparatus comprises one spiral, as shown in FIGS. 15A and 15B.

The fuel injection apparatus of the eighth embodiment according to the present invention has the following advantages.

Firstly, the accumulation piston 186 may be eliminated to allow the communicating bore 206 to communicate with the through hole 84. The distal end portion of the pressure pin 188 may function as the accumulation piston. However, in this case, the urging force of the spring 208 must be increased, and hence the urging force of the pressure pin 188 toward the left must be increased. If the urging force of the pressure pin 188 is weak, the pressure pin 188 is moved before the pressure in the fuel pressure chamber 14 reaches a predetermined value to open the injection nozzle. As a result, fuel injection is performed after movement of the pressure pin 188 is completed, thus resulting in inconvenience. When the accumulation amount is increased, the injection initiation time is delayed. Even if a plunger 18 is rotated, the injection period cannot be prolonged. When the urging force of the spring 208 is increased, the resistance to rotational movement of the pressure pin 188 is increased. However, in this embodiment as shown in FIG. 13, the accumulation piston 186 and the pressure pin 188 are hydraulically coupled to each other. Then, the urging force against the pressure from the fuel pressure chamber 14 is received by the spring 192, so that the spring 208 may use a spring having a considerably weaker urging force. Therefore, the resistance to the rotational movement of the pressure pin 188 can be greatly decreased. In a fuel injection apparatus where a feed pressure of the fuel is applied to the fuel supply chamber, the spring 208 may be eliminated.

Secondly, since the accumulation piston 186 need only be hydraulically coupled to the pressure pin 188, the cylinder pressure pins need not be disposed at one place, thus providing various mechanical design possibilities.

Thirdly, if the sectional area of the accumulation piston 186 is smaller than that of the pressure pin 188, the pressure in the oiltight chamber 100 in the hydraulic locking state can be decreased, thus improving the seal of the oiltight chamber 100.

In the fuel injection apparatus of the seventh and eighth embodiments, the control surfaces 80 of the pressure pins 188 respectively comprise a tilt surface and a helical surface having one spiral. However, control surfaces of ninth and tenth embodiments comprise shapes as shown in FIGS. 16A and 16B and FIGS. 17A and 17B, respectively. In the control surface according to the ninth embodiment shown in FIGS. 16A and 16B, the control surface 80 has two tilt surfaces each corresponding to a half pitch. Conversely, in the control surface according to the tenth embodiment shown in FIGS. 17A and 17B, the control surface 80 has two helical surfaces each corresponding to a half pitch.

Figure 18:
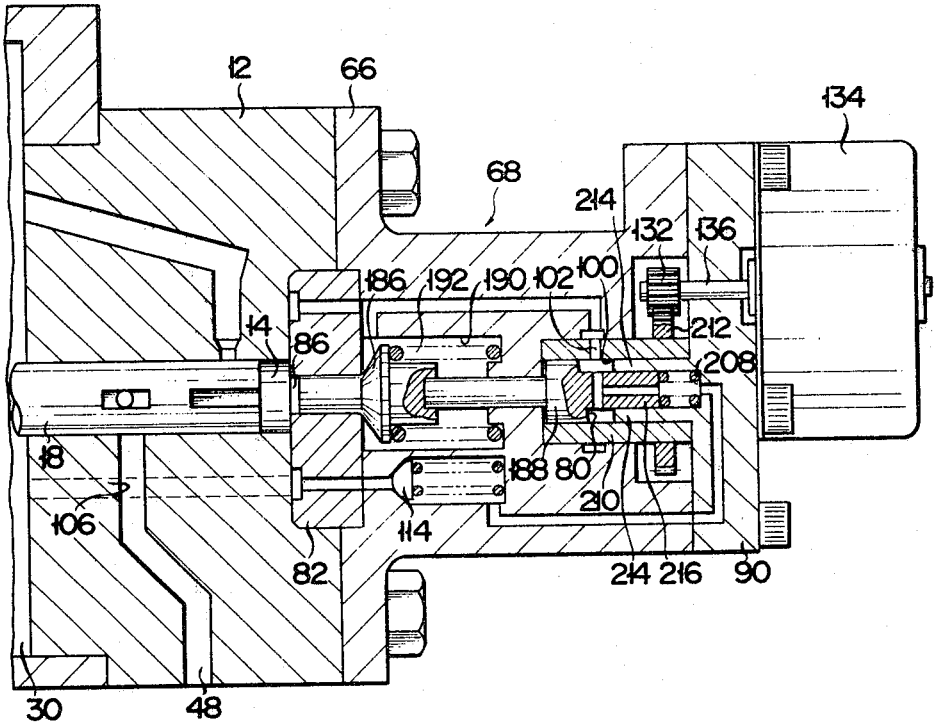
FIG. 18 is a sectional view of a fuel injection apparatus of an eleventh embodiment according to the present invention.
Figure 19:
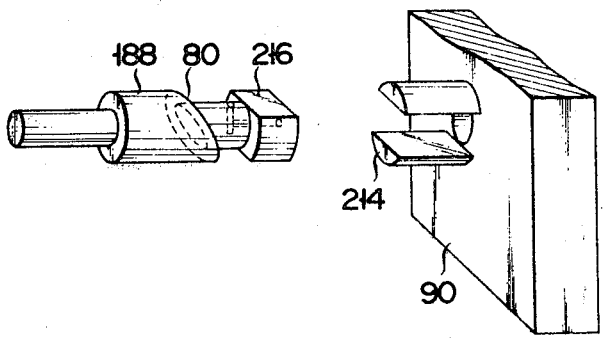
FIG. 19 is a perspective view of a pressure pin of the fuel injection apparatus shown in FIG. 18.

A fuel injection apparatus of an eleventh embodiment according to the present invention will be described with reference to FIGS. 18 and 19.

In the seventh embodiment, the control bore 102 is formed in the cylindrical body 90, and the pressure pin 188 having the control surface 80 is rotated. Thus, the stroke of the accumulation piston 186 is controlled. However, in the eleventh embodiment, rotational movement of the pressure pin 188 is prohibited, and a control cylinder 210 having the control bore 102 is rotated. Thus, the stroke of an accumulation piston 186 is controlled.

A control gear 212 is secured to the outer circumferential surface of the control cylinder 210. The control gear 212 meshes with the transmission gear 132 of the stepping motor 134. The rotational torque of the stepping motor 134 is transmitted to the control cylinder 210 through the transmission gear 132 and the control gear 212. The control cylinder 210 is slidably and rotationally fitted in an oiltight manner to the cap 66, a pair of projections 214 formed on the body 90, and the pressure pin 188. A prism portion 216 is secured to the right end portion of the pressure pin 188. The projections 214 respectively support two opposing sides of the prism portion 216 and function to prevent the pressure pin 188 from rotating. At the same time, the prism portion 216 is mounted to be slidable.

In the fuel injection apparatus according to the eleventh embodiment, no load from a spring or the like is applied to the pressure pin 188. Therefore, the resistance to rotational movement of the pressure pin 188 can be greatly decreased.

Figure 20:
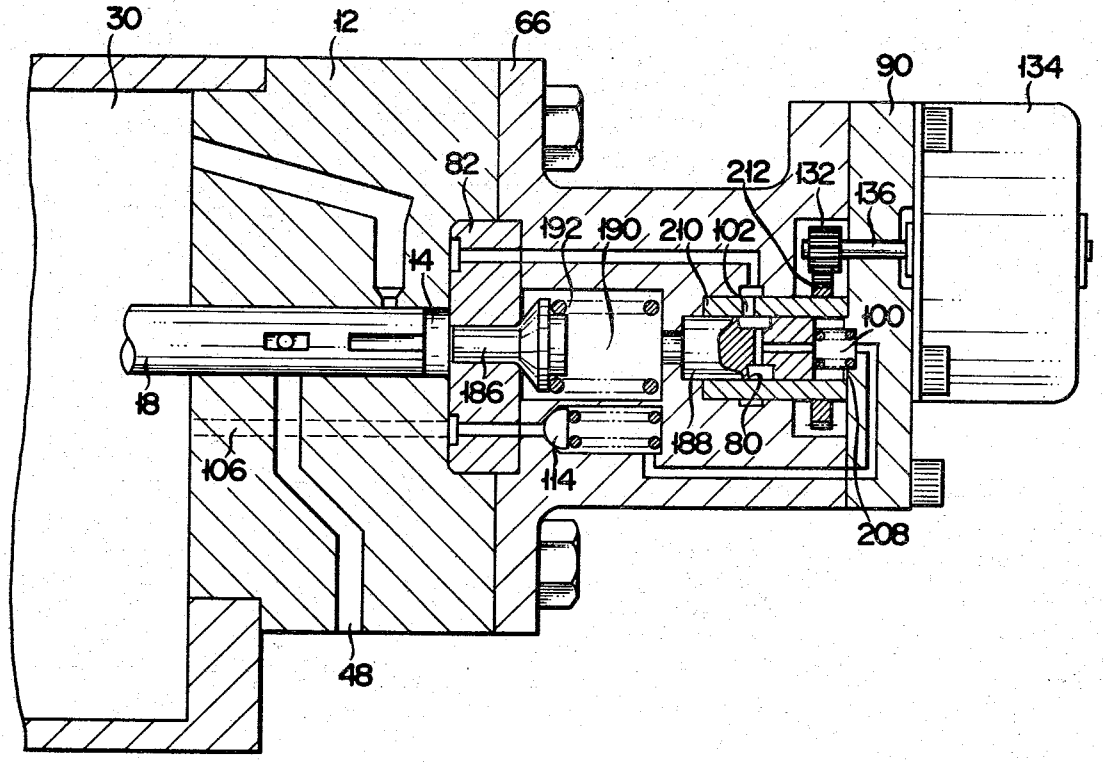
FIG. 20 is a sectional view of a fuel injection apparatus of a twelfth embodiment according to the present invention.

FIG. 20 shows a fuel injection apparatus of a twelfth embodiment according to the present invention. In this embodiment, the accumulation piston 186 is hydraulically coupled to the pressure pin 188, and stroke between the control bore 102 and the control surface 80 is controlled by rotating the control cylinder 210 having the control bore 102. The control cylinder 210 is rotated instead of rotating the pressure pin 188 having the control surface 80. The rotational movement of the pressure pin 188 is prohibited by a pair of projections 214 formed on the cylindrical body 90.

The fuel injection apparatus of the twelfth embodiment according to the present invention has the combined advantages of the eighth and eleventh embodiments.

Figure 21:
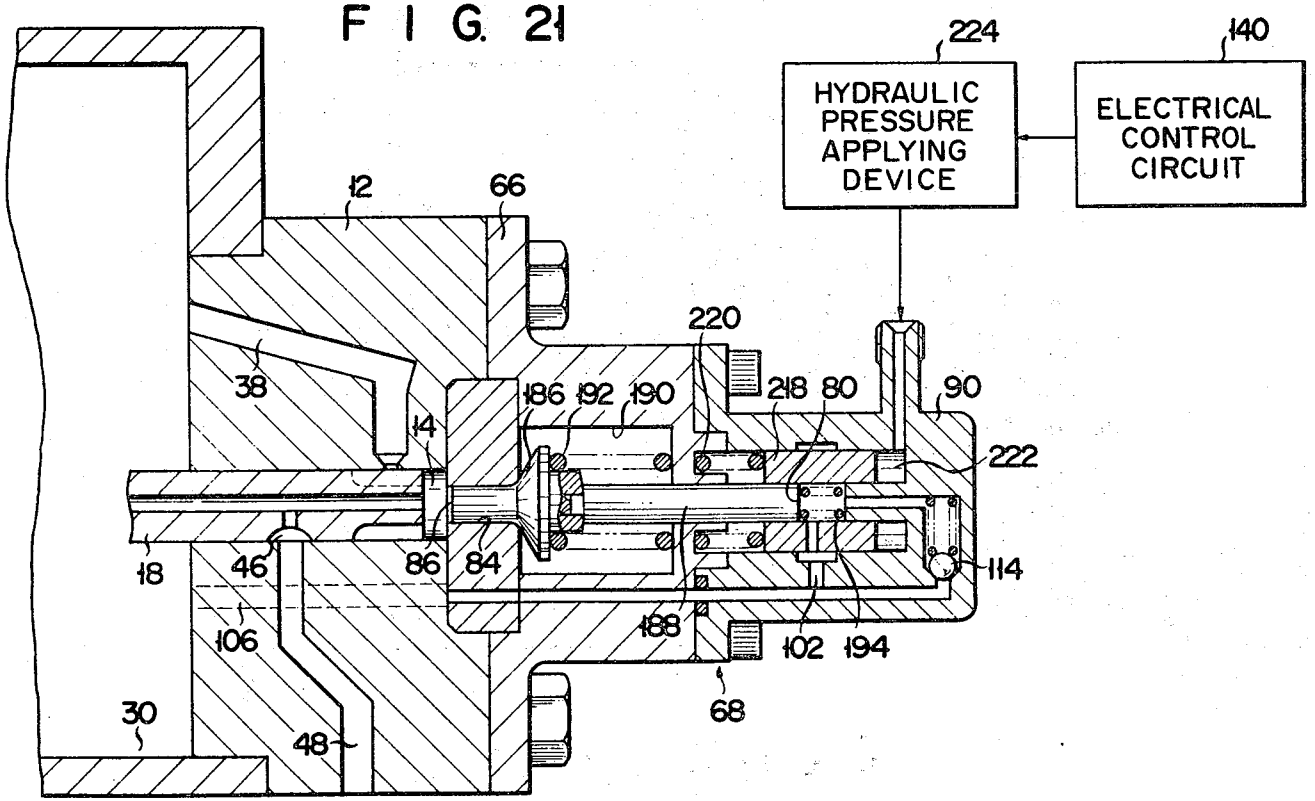
FIG. 21 is a sectional view of a fuel injection apparatus of a thirteenth embodiment according to the present invention.

A fuel injection apparatus of a thirteenth embodiment according to the present invention will be described with reference to FIG. 21. In this embodiment, the control surface 80 does not comprise a tilted surface. The stroke of the accumulation piston 186 and hence the pressure pin 188 so as to allow the control surface 80 to close the control bore 102 is controlled by sliding the control bore 102 to the left or right.

A control sleeve 218 is oiltightly inserted in the cylindrical body 90 to be slidable with respect to the inner face of the body 90 and the outer face of the pressure pin 188. The control sleeve 218 is urged to the right by a spring 220. A oil pressure chamber 222 is formed to the right of the control sleeve 218. When compressed oil is supplied from a hydraulic pressure applying device 224 to the oil pressure chamber 222, the pressure of the oil allows the control sleeve 218 to move to the left. When a balance is obtained, the control sleeve 218 stops. The oil pressure supplied to the oil pressure chamber 222 is controlled by the electrical control circuit 140. By changing the position of the control sleeve 218, the flat control surface 80 is slid to close the control bore 102 formed in the control sleeve 218, thus controlling the stroke of the accumulation piston 186 and the pressure pin 188.

The fuel injection apparatus of the thirteenth embodiment has the same effect and advantage as that according to the seventh embodiment.

Figure 22:
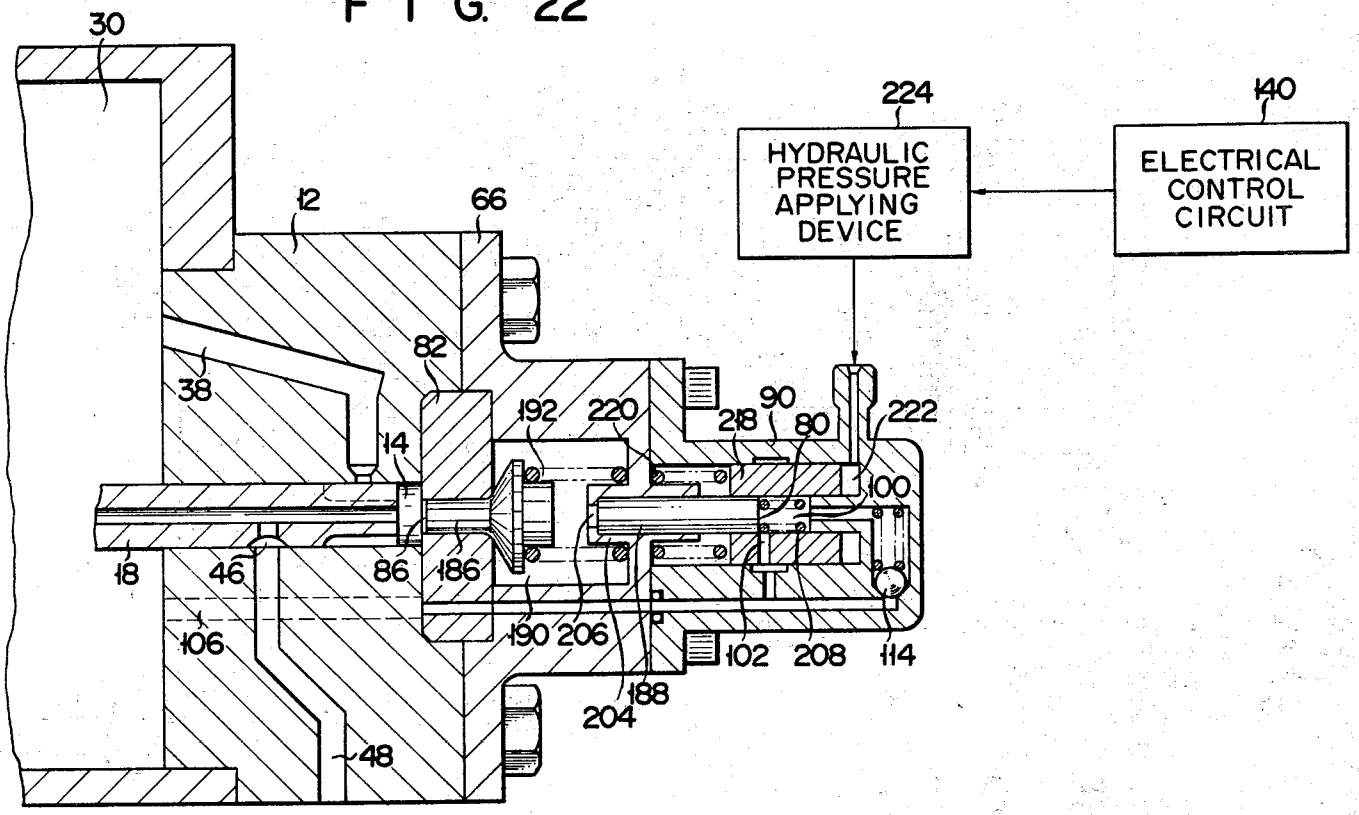
FIG. 22 is a sectional view of a fuel injection apparatus of a fourteenth embodiment according to the present invention.

FIG. 22 shows a fuel injection apparatus of a fourteenth embodiment according to the present invention. Referring to FIG. 22, the flat control surface 80 of a pressure pin 188 which is hydraulically coupled to the accumulation piston 186 is formed. The control sleeve 218 having the control bore 102 is slid to the right or left so as to control the stroke of the accumulation piston 186 and the pressure pin 188 in order to close the control bore 102 by the control surface 80. The fuel injection apparatus of the fourteenth embodiment has the same effect as that of the eighth embodiment.

Figures 23, 24:
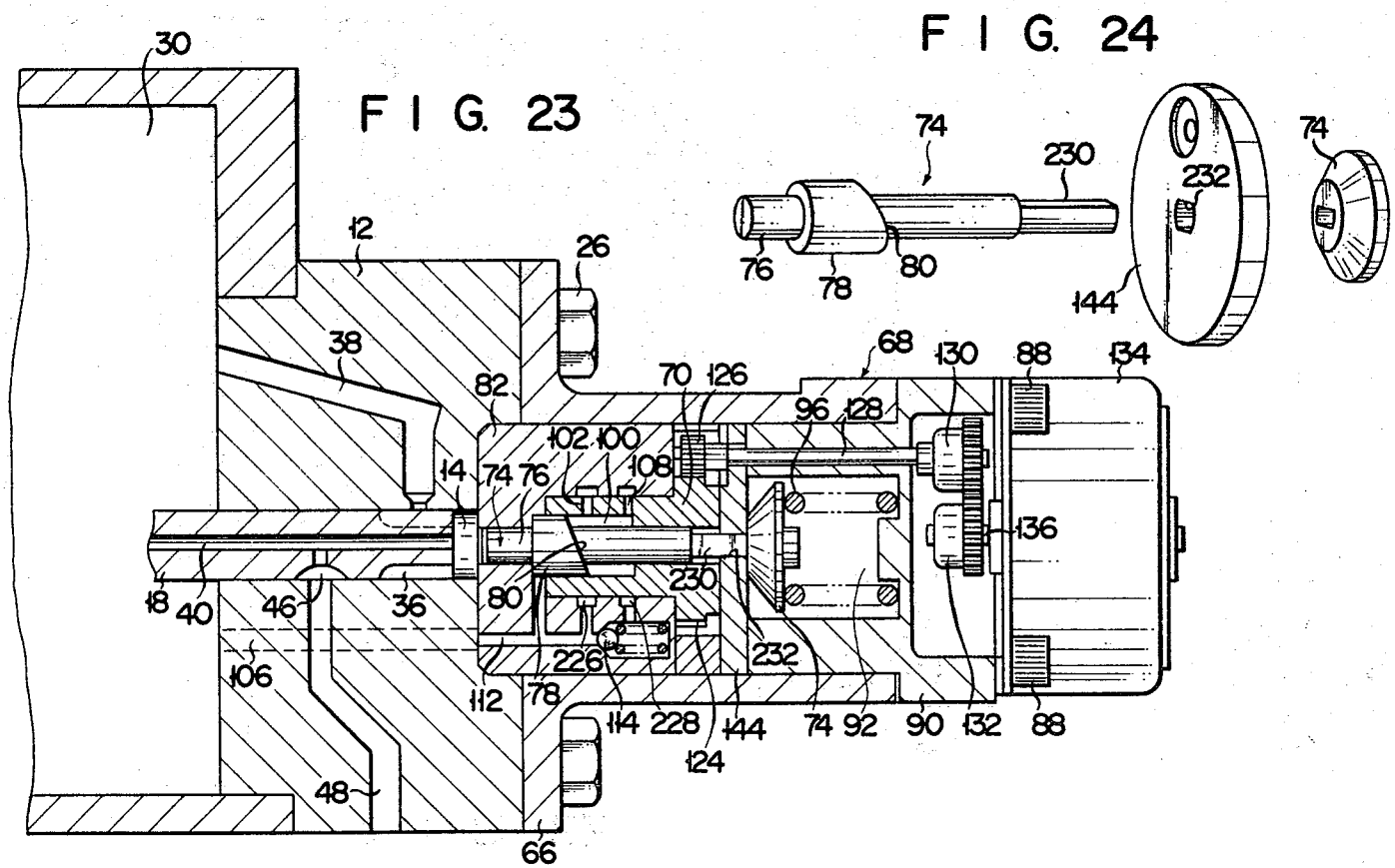
FIG. 23 is a sectional view of a fuel injection apparatus of a fifteenth embodiment according to the present invention.
FIG. 24 is a perspective view of a piston of the fuel injection apparatus shown in FIG. 23.

In the first embodiment, the cylinder 70 is secured to the cap 66. However, as a fifteenth embodiment shown in FIGS. 23 and 24, the cylinder 70 may be disposed to be rotational, while the cylinder 74 is axially movable but not rotatable.

The cylinder 70 is pivotally inserted in the seat 82. The driven spur gear 124 is integrally mounted on the outer face of the cylinder 70. The driven spur gear 124 meshes with the driving spur gear 126. Two annular grooves 226 and 228 are formed on the inner face of the seat 82 which slidably contacts the outer face of the cylinder 70. The annular groove 226 communicates with the control bore 102, while the annular groove 228 communicates with the intake bore 108.

The accumulation piston and the pressure pin are integrally formed to constitute the piston 74. A double surface portion 230 is formed at the right end face of the cylindrical body 76 of the piston 74. The distal end of the double surface portion 230 is inserted in a through hole 232 of a stopper plate 144. Therefore, the piston 74 is slidable but is not rotatable.

The fuel injection apparatus of the fifteenth embodiment has the same effect as that of the first embodiment.

Figure 25:
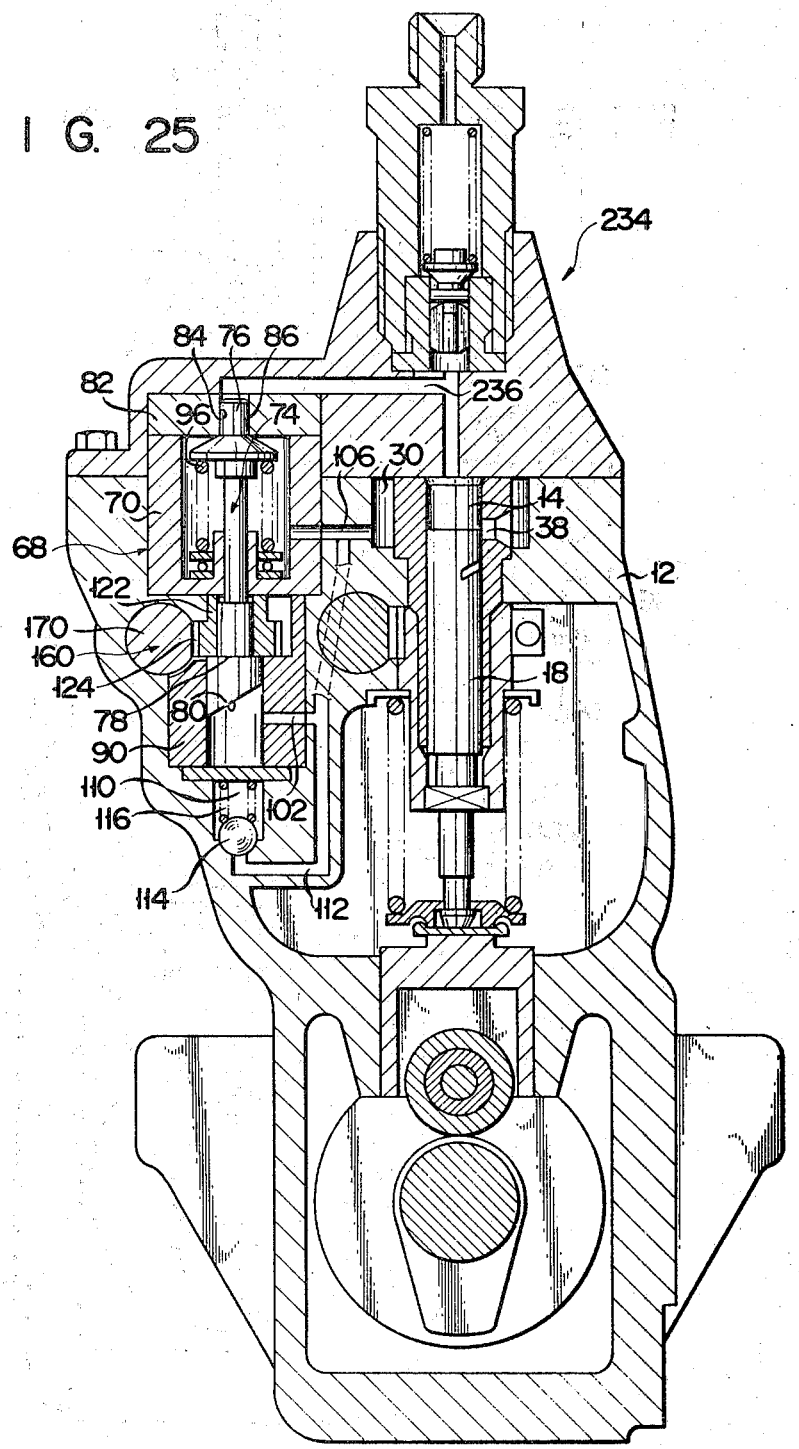
FIG. 25 is a sectional view of a line fuel injection apparatus of a sixteenth embodiment according to the present invention.

In the first to fifteenth embodiments described above, distributor-type fuel injection apparatuses 10 are exemplified. However, the present invention may be applied to a line fuel injection apparatus of a sixteenth embodiment as shown in FIG. 25.

The accumulator 68 mounted in a line fuel injection apparatus 234 of the sixteenth embodiment is the same as that of the first embodiment. The fuel injection apparatus 234 is substantially the same as that of the first embodiment, except that the fuel pressure chamber 14 and the accumulation chamber 86 communicate with each other through a communicating bore 236. The construction of the main body of of the line fuel injection apparatus is known to those who are skilled in the art, and a detailed description thereof will be omitted.

Figure 26:
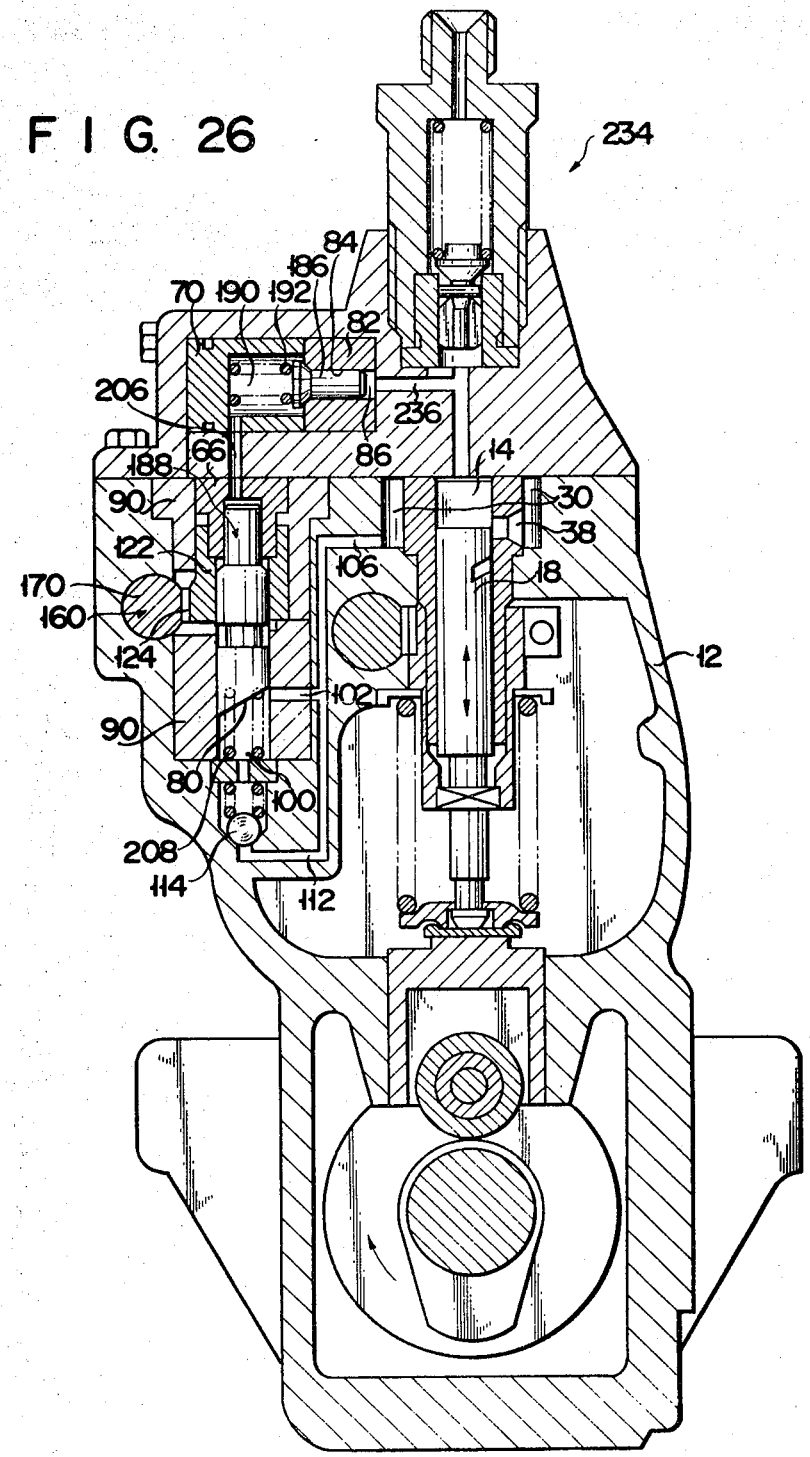
FIG. 26 is a sectional view of a line fuel injection apparatus of a seventeenth embodiment according to the present invention.

The accumulator 68 mounted in a line fuel injection apparatus of a seventeenth embodiment shown in FIG. 26 is the same as that of the eighth embodiment. All accumulators used in the distributor-type fuel injection apparatuses can be used for line fuel injection apparatuses.

In the sixteenth and seventeenth embodiments, piston rotating mechanisms 160 respectively have racks 170 which mesh with driven spur gears 124 secured to the outer faces of gear holders 122 which are rotated together with pistons 74 or pressure pins 188. Each of the racks 170 reciprocates by means of the linear solenoid shown in FIG. 7 to rotate the piston 74 or the pressure pin 188.

What we claim is:

1. A fuel injection apparatus for injecting a high-pressure fuel to each combustion chamber of an internal combustion engine, comprising:

(A) a fuel injection pump including (a) a pump housing having a fuel supply chamber, (b) a pump cylinder formed in said pump housing, and (c) a pump piston disposed in said pump cylinder to be reciprocal in synchronism with operation of said internal combustion engine, said pump piston and said pump cylinder together defining a fuel pressure chamber, whereby the fuel is supplied from said fuel supply chamber to said fuel pressure chamber upon movement of said pump piston away from said pump cylinder, and the fuel is compressed in said fuel pressure chamber upon movement of said pump piston toward said pump cylinder, the high-pressure fuel being injected into said each combustion chamber of said internal combustion engine; and (B) an accumulator fixed to said pump housing to control an amount of injection and an injection period of the high-pressure fuel compressed and supplied from said fuel pressure chamber in accordance with the operation of said internal combustion engine, said accumulator including cylinder means having a first cylinder portion and a second cylinder portion, piston means having a first piston portion and a second piston portion which are respectively disposed in said first cylinder portion and said second cylinder portion to be reciprocal therein, said first cylinder portion and said first piston portion forming an accumulation chamber which communicates with said fuel pressure chamber, said first cylinder portion and said second cylinder portion forming an oiltight chamber, said second cylinder portion having a control bore which allows said fuel supply chamber to communicate with said oiltight chamber and is closed by said second piston portion, and said oiltight chamber being closed when a relative distance between said control bore and said second piston portion is changed to close said control bore by said second piston portion, thereby stopping movement of said second piston portion, coupling means for coupling said first piston portion and said second piston portion to regulate movement of said first piston portion in synchronism with the movement of said second piston portion, and driving means for driving one of said second cylinder portion and said second piston portion in accordance with an operating condition of said internal combustion engine, and for changing the relative distance between said control bore and said second piston portion to regulate a distance of movement of said second piston portion necessary to close said control bore, thereby defining a maximum volume of said accumulation chamber.

2. The apparatus according to claim 1, wherein said piston means comprises a piston which integrally has said first and second piston portions.

3. The apparatus according to claim 2, further comprising urging means for urging said piston to decrease a volume of said accumulation chamber.

4. The apparatus according to claim 3, wherein said piston has a control surface which is located in said oiltight chamber, said control surface being constituted to change a distance between said control surface and said control bore when said second piston portion is rotated about a central axis thereof.

5. The apparatus according to claim 4, wherein said driving means rotates said piston.

6. The apparatus according to claim 5, wherein said control surface comprises a tilt surface which is inclined by a predetermined angle with respect to an axis of said piston.

7. The apparatus according to claim 5, wherein said control surface comprises a helical surface.

8. The apparatus according to claim 4, wherein said driving means rotates said second cylinder portion.

9. The apparatus according to claim 8, wherein said control surface comprises a tilt surface which is inclined by a predetermined angle with respect to an axis of said piston.

10. The apparatus according to claim 8, wherein said control surface comprises a helical surface.

11. The apparatus according to claim 3, wherein said piston has a control surface which is located in said oiltight chamber, and said driving means axially moves said second cylinder portion to change a distance between said control surface and said control bore.

12. The apparatus according to claim 11, wherein said control surface comprises a surface which is perpendicular to an axis of said piston.

13. The apparatus according to claim 1, wherein said piston means separately includes said first piston portion and said second piston portion.

14. The apparatus according to claim 13, further comprising first urging means for urging said first piston portion to decrease the volume of said accumulation chamber, and second urging means for urging said second piston portion toward said first piston portion.

15. The apparatus according to claim 14, wherein said second piston portion is rotatably inserted in said first piston portion and is moved together with said first piston portion by said second urging means.

16. The apparatus according to claim 15, wherein said second piston portion has a control surface which is located in said oiltight chamber, said control surface being constituted to change a distance between said control surface and said control bore when said second piston portion is rotated about an axis thereof.

17. The apparatus according to claim 16, wherein said driving means rotates said second piston portion.

18. The apparatus according to claim 17, wherein said control surface comprises a tilt surface which is inclined by a predetermined angle with respect to an axis of said piston.

19. The apparatus according to claim 17, wherein said control surface comprises a helical surface.

20. The apparatus according to claim 16, wherein said driving means rotates said second cylinder portion.

21. The apparatus according to claim 20, wherein said control surface comprises a tilt surface which is inclined by a predetermined angle with respect to an axis of said piston.

22. The apparatus according to claim 20, wherein said control surface comprises a helical surface.

23. The apparatus according to claim 15, wherein said second piston portion has a control surface which is located in said oiltight chamber, and said driving means axially moves said second cylinder portion to change a distance between said control surface and said control bore.

24. The apparatus according to claim 23, wherein said control surface comprises a surface which is perpendicular to an axis of said piston.

25. The apparatus according to claim 14, wherein said second piston portion is hydraulically coupled to said first piston portion and is moved together with said first piston portion by said second urging means.

26. The apparatus according to claim 25, wherein said second piston portion has a control surface which is located in said oiltight chamber, said control surface being constituted to change a distance between said control surface and said control bore when said second piston portion is pivoted about an axis thereof.

27. The apparatus according to claim 26, wherein said driving means rotates said second piston portion.

28. The apparatus according to claim 27, wherein said control surface comprises a tilt surface which is inclined by a predetermined angle with respect to an axis of said piston.

29. The apparatus according to claim 27, wherein said control surface comprises a helical surface.

30. The apparatus according to claim 26, wherein said driving means rotates said second cylinder portion.

31. The apparatus according to claim 30, wherein said control surface comprises a tilt surface which is inclined by a predetermined angle with respect to an axis of said piston.

32. The apparatus according to claim 30, wherein said control surface comprises a helical surface.

33. The apparatus according to claim 25, wherein said second piston portion has a control surface which is located in said oiltight chamber, and said driving means axially moves said second cylinder portion to change a distance between said control surface and said control bore.

34. The apparatus according to claim 33, wherein said control surface comprises a surface which is perpendicular to an axis of said piston.

35. The apparatus according to claim 1, further comprising valve means, disposed between said oiltight chamber and said fuel supply chamber, for allowing the fuel to flow from said fuel supply chamber to said oiltight chamber and for prohibiting the fuel to flow from said oiltight chamber to said fuel supply chamber.

36. The apparatus according to claim 1, wherein said fuel injection pump utilizes a line-type fuel injection pump.

37. The apparatus according to claim 1, wherein said fuel injection pump utilizes a distributor-type fuel injection pump.

* * * * *